United States Patent [19]

Haines

[11] 4,130,005

[45] Dec. 19, 1978

[54] HIGH SPEED BALL HEADER

[75] Inventor: Allan D. Haines, Tiffin, Ohio

[73] Assignee: The National Machinery Company, Tiffin, Ohio

[21] Appl. No.: 824,927

[22] Filed: Aug. 15, 1977

Related U.S. Application Data

[63] Continuation-in-part of Ser. No. 699,892, Jun. 25, 1976.

[51] Int. Cl.[2] ..... B21D 72/00

[52] U.S. Cl. ..... 72/360; 10/11 R; 72/441; 72/443

[58] Field of Search ..... 72/360, 352, 441, 443, 72/337; 10/11 R, 12 R, 15 R, 76 R

[56] References Cited

U.S. PATENT DOCUMENTS

| | | | |
|---|---|---|---|
| 1,007,792 | 11/1911 | Orton | 72/443 X |
| 1,204,127 | 11/1916 | Canada | 72/360 X |
| 1,910,384 | 5/1933 | Ekjergian | 72/360 X |
| 2,073,239 | 3/1937 | Byerlein | 72/443 X |
| 3,747,144 | 7/1973 | Meerendenk | 10/12 R |
| 3,859,838 | 1/1975 | Karsnok | 10/11 R X |
| 3,919,874 | 11/1975 | Harris | 72/337 |

*Primary Examiner*—Leon Gilden

*Attorney, Agent, or Firm*—McNenny, Pearne, Gordon, Gail, Dickinson & Schiller

[57] ABSTRACT

A method and apparatus of cold forming is disclosed for improving die life. During a first phase a workpiece is initially engaged between a pair of dies with a sufficiently low force and velocity level to reduce die errosion but with a sufficiently high level to produce limited deformation of the workpiece and provide an area of mating engagement between the workpiece and the tool and die. During a second phase the workpiece is subjected to substantially higher deforming force and velocity levels and is further deformed to the desired shape. Such area of mating engagement is sufficiently large to reduce errosion producing localized pressures on the tool and die during such second phase. The disclosed machine is a ball header with the movable die mounted directly on the machine frame rather than on the reciprocating slide. The position of the movable die is controlled by a cam driven pusher so that the movable die position is independent of the position of the reciprocating slide. In such machine a workpiece is initially gripped during such first phase while the movement of the tool is controlled by the cam. In the second phase the tool is driven forward by the crank driven slide.

8 Claims, 12 Drawing Figures

Fig. 1
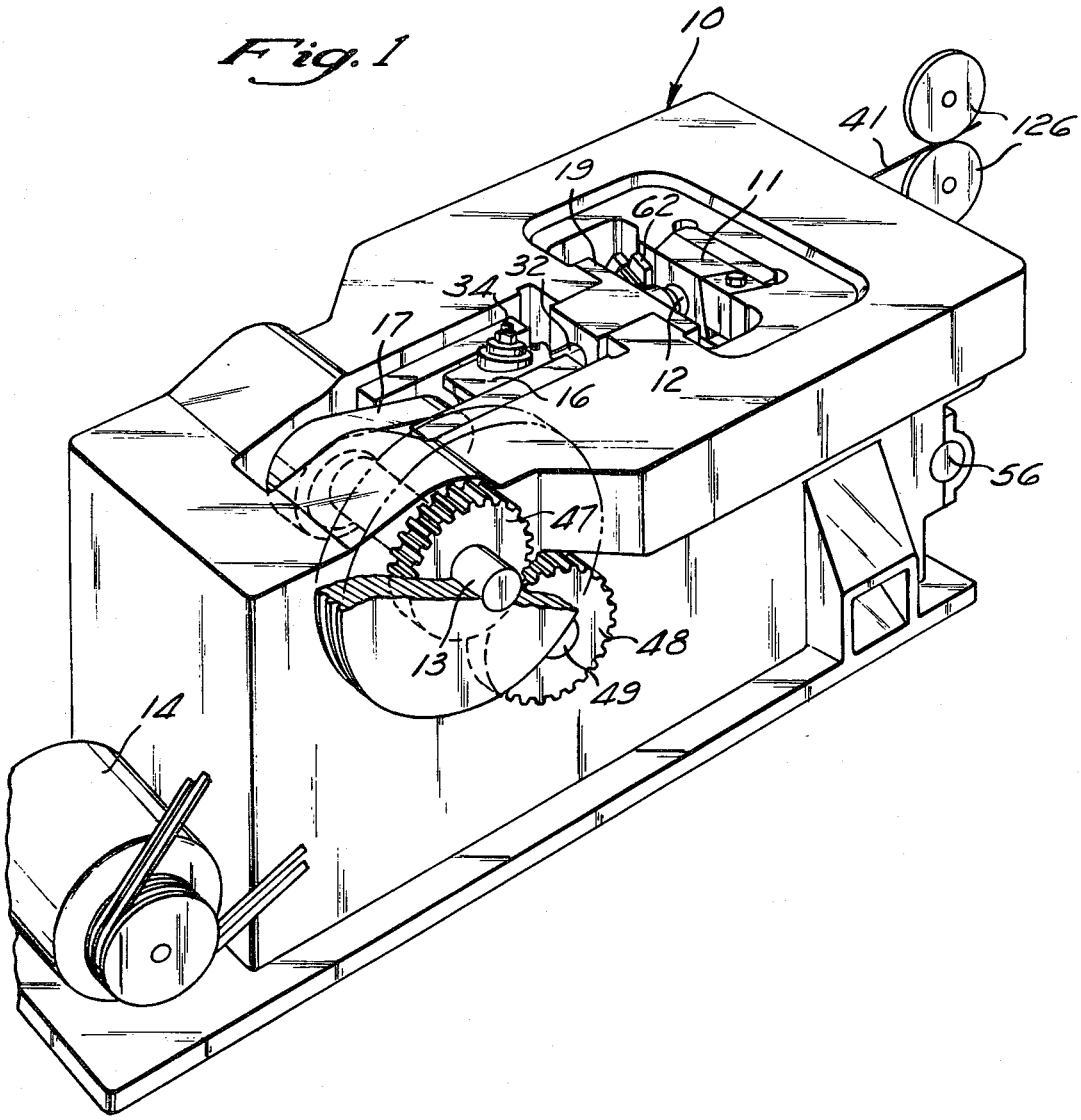
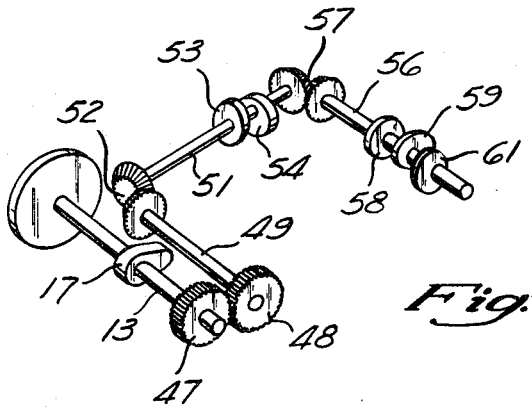
Fig. 1a

HIGH SPEED BALL HEADER

BACKGROUND OF THE INVENTION

This is a continuation-in-part application of the copending application Ser. No. 699,892 filed June 25, 1976.

This invention relates generally to headers or the like and more particularly to a novel and improved method and apparatus for forming parts such as balls, tapered rollers, barrel rollers, phillips head screws, or the like, with improved die life.

PRIOR ART

Ball headers are often used to form a rough or intermediate ball from a cylindrical blank. Usually such intermediate ball is formed with a general ball shape and has centrally located flash along an equator extending radially around the ball. The intermediate or rough ball is usually tumbled to remove the flash, heat treated and ground to the final size and finish.

In at least some prior art ball headers, the movable die has been mounted on a reciprocating header slide for limited movement with respect to the slide in the direction of slide movement. In such machines a transfer positions the blank for gripping by the dies and the movable die is carried by the slide to a gripping position in which the blank is gripped between the dies to establish blank control before the transfer is retracted. The transfer is then retracted while the movable die remains stationary and the slide continues to move forward. The length of time available for the retraction of the transfer has been determined by the speed of the slide and the amount of movement permitted between the slide and movable die.

In practice the speed of the machine has been limited in such prior art machines to provide sufficient time to allow retraction of the transfer after the gripping control of the blank is established by the dies.

Such prior art machines have also generally utilized an open cutter which does not produce as accurate a cut as a closed or bushing cutter when shearing a blank from wire stock. Consequently, it has been necessary to operate the machine with substantial flash to ensure a complete filling of the ball. Also, it has been necessary to form oversized intermediate balls to ensure that the ground and finished ball is provided with the proper shape and finish.

Savings are achieved in two ways if the size of the ball can be reduced or the amount of flash can be reduced without sacrificing the quality of the finished part. First the quantity of material required to produce a given finished ball is reduced so material savings result. Second the expense of removing flash and expense of grinding is reduced when the forged ball is closer to the finished size and the amount of flash is reduced.

Further in such machine the velocity of initial contact between the tooling and the workpiece is determined by the velocity of the slide at the moment the workpiece or blank is engaged. In practice a high contact velocity exists when the sharp edges of the blank are engaged which produces points of extremely high localized pressure. During the operation of the machine the surfaces of the tooling are erroded away by such high localized pressure and the die must be replaced or refinished when the extent of errosion is sufficient to prevent further use of the dies to manufacture satisfactory parts.

SUMMARY OF THE INVENTION

In accordance with the present invention a method and apparatus is provided to substantially reduce the rate of tooling errosion so that a given pair of dies can be used to produce substantially greater numbers of workpieces before sufficient errosion or wear occurs to require replacement or refinishing of the dies.

In accordance with this invention the working of the blank occurs in two sequential phases. During the first phase the blank is engaged by the dies while the dies are closing at a relatively low velocity so that excessive localized pressures do not occur. The force level of engagement however, is sufficiently high so that limited deformation of the blank occurs to produce an area of mating engagement between the blank and each of the dies. Such area of mating engagement, which is present at the commencement of the second phase, distributed the high level force, required for the principal working of the blank, over sufficient area to eliminate or substantially reduce the level of pressure against the surface of the tooling so the rate of errosion is very substantially reduced.

During tests on the machine disclosed herein the useful tool life encountered appears to be at least two to three times the tool life experienced with comparable prior art machines of the type described above. This improved tool life has been achieved in spite of the fact that the machine has been operated at substantially higher speeds than such prior art machines.

These and other aspects of the present invention are discussed in the following detailed description.

BRIEF DESCRIPTION OF THE DRAWINGS

FIG. 1 is a prospective view of a ball header incorporating the present invention.

FIG. 1*a* is a schematic illustration of the cam-shaft system of the machine;

DETAILED DESCRIPTION OF THE DRAWINGS

The drawings illustrate the machine disclosed and claimed in the prior copending application cited above and such application is incorporated by reference.

Figure 2:
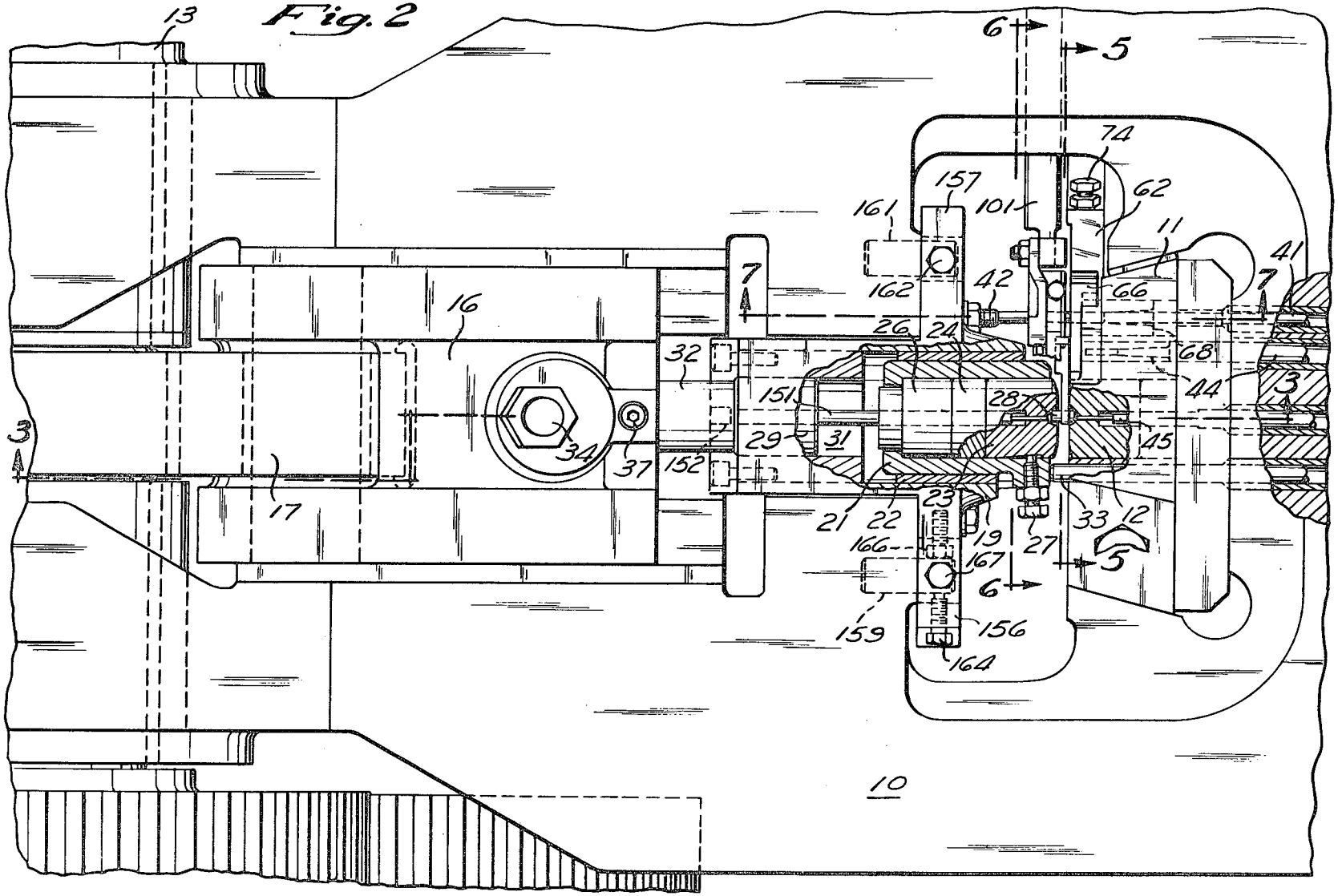
FIG. 2 is a plan view partially in section illustrating the structural arrangement of the machine.
Figure 3:
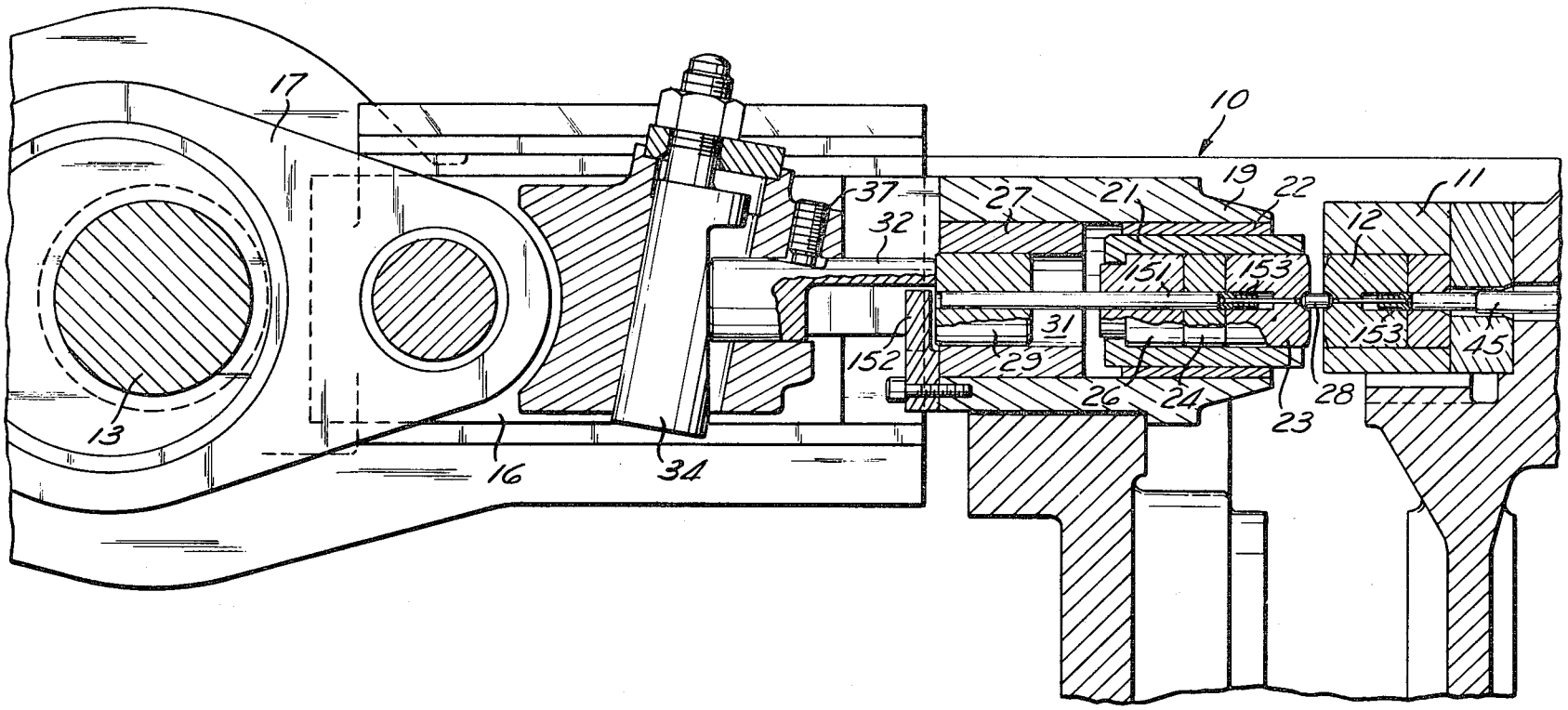
FIG. 3 is a slide elevation taken generally along 3—3 of FIG. 2.

Referring to FIGS. 1 through 3 the machine includes a frame 10 which supports a removable die breast 11 in which a stationary die 12 is mounted. Journaled on the frame 10 is a crankshaft 13 powered by a motor 14. A reciprocating slide 16 is supported in the frame for a reciprocating movement toward and away from the die breast 11 and is connected to the crankshaft 13 by a pitman 17 in the usual manner so that the slide moves back and forth through one complete cycle during each 360° of rotation of the crankshaft.

A movable tool or die holder 21 is supported on the frame for movement in the same direction as the slide 16. The structure for supporting the movable tool is best illustrated in FIGS. 2 and 3 and includes a stationary die support 19 removably mounted on the frame 10 of the machine. Movable die holder 21 is slidably supported in a cylindrical bearing 22 within the die support 19 for limited movement in the frame 10 toward and away from the die breast 11. The movable die 23 is positioned forward of two spacer blocks 24 and 26. A lock screw 27 locks the movable die and blocks in the movable die holder 21.

The die holder 21 is free to move from a blank gripping position illustrated in FIGS. 2 and 3 forward to an extended position adjacent to the stationary die 12 and a cylindrical blank 28 is formed from the cylindrical shape to the required rough or intermediate ball shape during such movement. The die holder 21 also allows rearward or retraction movement from the gripping position illustrated to separate the two dies 12 and 23 sufficient to allow rejection of a workpiece and the transfer of a subsequent blank into position for working.

Mounted within a bearing sleeve 27 at a location spaced back from the die holder 21 is a sliding member 29 which cooperates with the die holder to define a chamber 31 which is supplied through an inlet (not illustrated) with compressed air. The compressed air functions to resiliently bias the die holder 21 forward in the direction toward the stationary die 12 and biases the sliding member 29 rearwardly into engagement with a drive member 32 carried by the slide 16. Therefore, the die holder 21 is continuously urged toward the stationary die into engagement with a die pusher 33 which is described in greater detail below. A wedge 34 is provided to adjustably position the drive member 32 with respect to the slide 16 and is provided with a nut for adjustably positioning and locking the wedge. In the event that the machine is stalled in the forward dead center position release of the wedge permits the freeing of the machine. A screw 37 operates to lock the drive member against the face of the wedge when the wedge is properly adjusted.

Since the sliding member 29 is maintained against the forward end of the drive member 32 by the pressure within the chamber 31 it reciprocates back and forth with the slide 16. The slide 16 and in turn the sliding member 29 are illustrated in FIGS. 2 and 3 at the back dead center position and the sliding member 29 is substantially spaced from the rearward face of the spacer block 26. As the slide 16 is carried forward toward the forward dead center position the sliding member 29 moves into engagement with the spacer block 26 and thereafter moves the movable die 23 toward the stationary die 12 to perform a working operation on the blank 28. Subsequently, as the slide 16 commences to move back toward its back dead center position the slider member 29 moves back from the spacer block 26 and the movable die does not move back from the stationary die with the slide. Instead the die pusher 33 illustrated in FIG. 2 functions to separate the two dies in the manner discussed below.

With this structure the position of the movable die 23 is independent of the position of the slide 16 excepting during the actual working portion of the stroke when the movable die is moved forward by the slide to upset the blank 28 to the required shape. Therefore the movement of the die 23 can and is controlled to provide the optimum timing of the other machine operations and the speed of the machine can be increased.

Referring to FIG. 2 wire stock 41 is fed into the machine from the right side as viewed in FIG. 2 to a stock gauge 42. A cutter 66 operates to shear the blanks 28 from the stock 41 and carried the blank to a transfer station in alignment with a transfer pin 44. The transfer pin 44 operates to eject blank from the cutter 66 into transfer fingers 46 which in turn carry the blank 28 to the working position between the dies 12 and 23 while the dies are separated by the pusher 33. The operation of the machine is timed so that the pusher 33 retracts allowing the air within the chamber 31 to move the die holder 21 to the illustrated position in which the ends of the blank are gripped between the two dies to maintain control of the blank when the transfer fingers 46 are retracted clear of the dies. This gripping occurs during the first phase of blank forming as described in detail below. Subsequently, during the second phase, the slide 16 operates to drive the movable die 23 forward as the slide moves to its forward dead center position to work the blank to the required generally spherical shape.

Referring to FIG. 1*a* a group of cams operate the various mechanisms of the machine and the cams are driven in timed relationship to the slide movement by a camshaft arrangement schematically illustrated in FIG. 1*a*. The crankshaft 13 is provided with a gear 47 mounted on one end which meshes with a driven gear 48 sized to provide a one to one speed ratio. The gear 48 is mounted on a cross shaft 49 which drives a longitudinally extending shaft 51 through a pair of miter gears 52.

Two cams 53 and 54 are mounted on the longitudinally extending shaft 51. The first cam 53 is utilized to operate the transfer and the second cam 54 operates the cutter arm 62. A second laterally extending shaft 56 is driven from the shaft 51 through a second pair of miter gears 57 and is provided with three cams 58, 59 and 61. The cam 58 operates the transfer pin 44 to eject the blank from the cutter into the transfer, the cam 59 operates the ejector 45 and the cam 61 operates the die pusher 33. The structure of the various cam driven mechanisms is discussed in greater detail below. Since all of the various cams are driven at the same speed as the crankshaft each cam rotates through 360° during a given machine cycle, and the timing of the various operating mechanisms controlled by the cams are automatically timed with the operation of the slide and with the operation of the other mechanisms.

Figure 5:
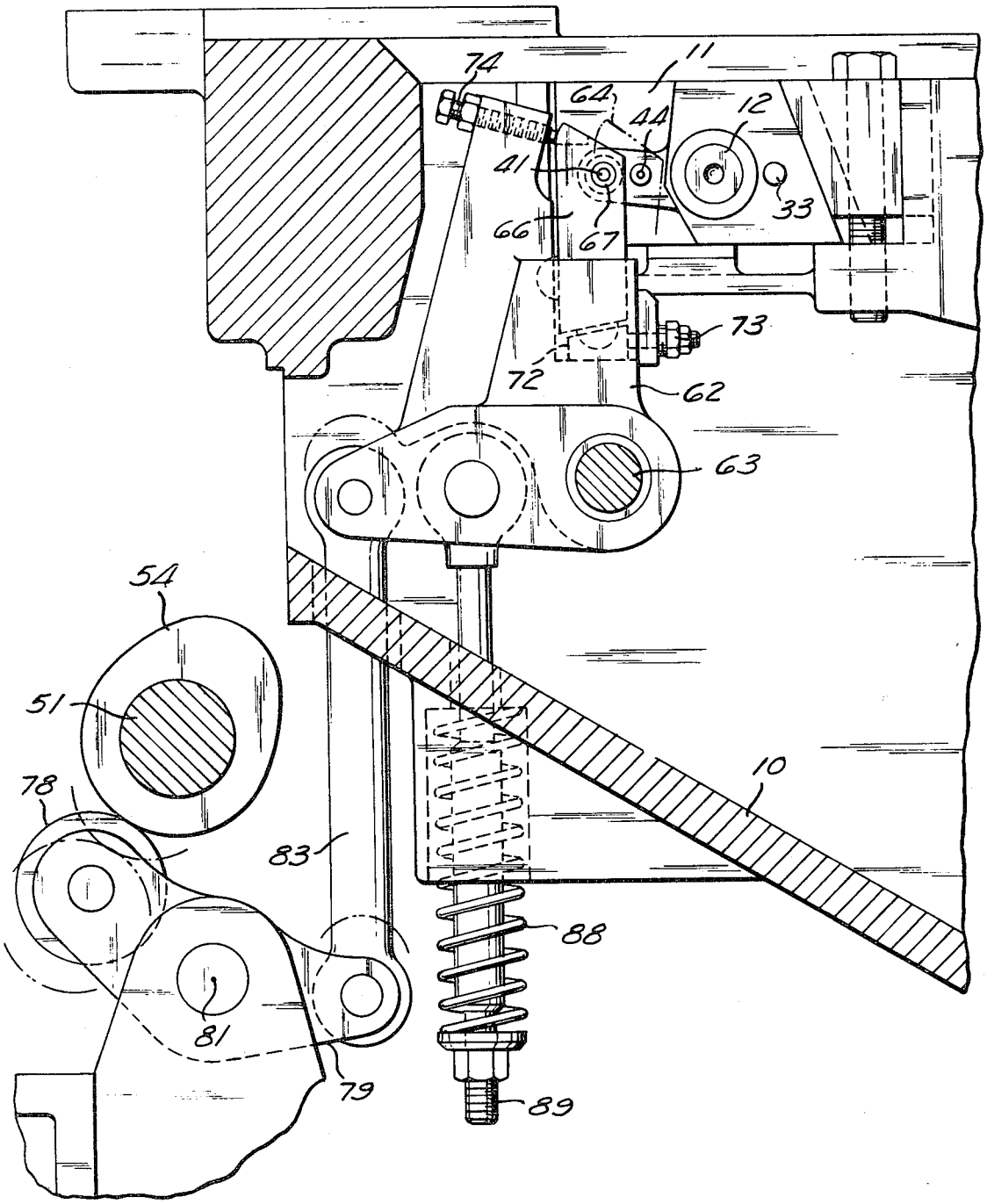
FIG. 5 is a fragmentary cross section taken generally along 5—5 of FIG. 2 illustrating the face of the stationary die and the cutter mechanism.
Figure 7:
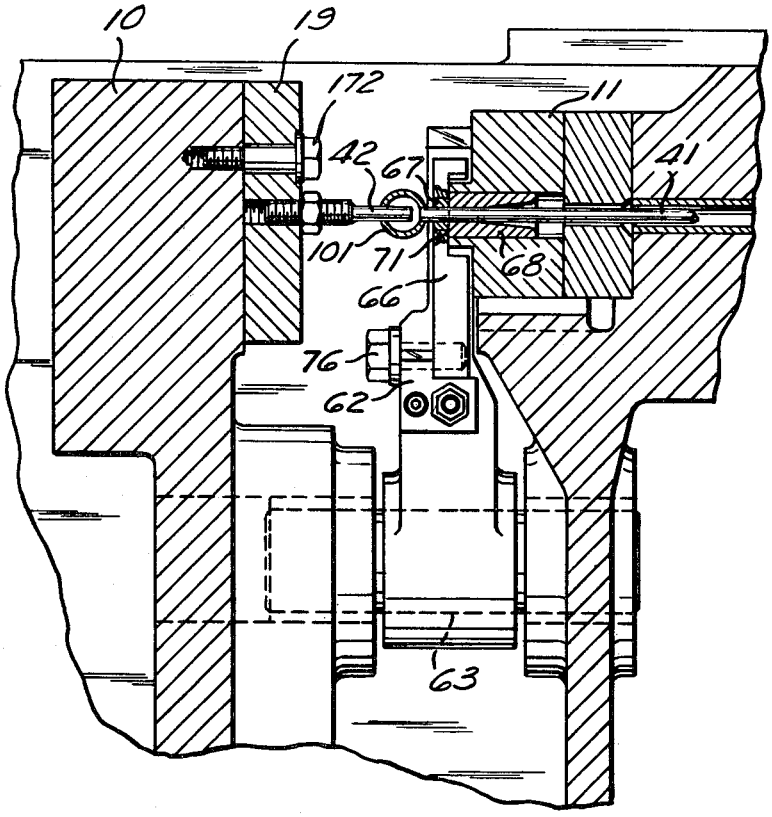
FIG. 7 is a fragmentary cross section taken generally along 7—7 of FIG. 2 illustrating the structure of the stock gauge and its adjustment mechanism.

Referring to FIGS. 5 and 7 the cutter arm 62 is supported on a pivot shaft 63 for oscillating rotation between the position illustrated in FIG. 5 and an operated position illustrated in phantom at 64. Carried by the cutter arm 62 is a cutter blade 66 provided with a hardened cutter ring 67 through which the wire stock 41 is fed while the cutter is in the position of FIG. 5. A hardened cutter ring 68, fixed against movement with respect to the machine frame 10, constitutes the other part of the shear. While the cutter is in the position of FIG. 5 the feed rolls operate to push the wire stock 41 forward through the two cutter rings 67 and 68 until the forward end of the stock engages the stock gauge pin 42. The position of the stock gauge pin is adjustable. The cutting or shearing plane 71 is located centrally with respect to the cutter arm 62 and in turn centrally with respect to the bearing supporting the pivot shaft 63 as best illustrated in FIG. 7. Therefore, the cutting loads to not produce twisting or material bending of the structure.

After the stock has been fed forward into engagement with the stock gauge pin, the cutter arm 62 is rotated in a clockwise direction as illustrated in FIG. 5 causing a blank 28 to be sheared from the forward end of the stock 41 and causing the blank to be carried within the ring 67 into alignment with the transfer pin 44. With the illustrated structure in which a solid cutter ring or bushing is provided, a cleaner and more accurate cut is made so greater blank uniformity is achieved and the ends of the blank are provided with better squareness than is obtainable when using an open cutter or the like.

It should be understood that even with a closed cutter of this type the ends of the blank are rough, somewhat irregular and have sharp points.

The cutter blade is adjustably mounted on the cutter arm by means of a wedge 72 which is adjustably positioned by a screw 73 for vertical position adjustment. Lateral position adjustment is provided by a screw 74. With this arrangement adjustment of the position of the cutter ring 67 can be provided. A lock screw 76 secures the cutter to the cutter arm as illustrated in FIG. 7. Such screw has not been illustrated in FIG. 5 in order to simplify the drawing.

The oscillating movement of the cutter arm 62 is produced by a cam driven linkage best illustrated in FIG. 5. The cam 54 mounted on the shaft 51 is engaged by a cam follower 78 and is mounted on a rocker arm 79 pivoted for rotation about an axis 81. Mounted on the other end of the arm 79 is a link 83 which moves up and down as the rocker arm 79 is pivoted by the cam 54. Top end of link 83 is connected to the arm 62.

A spring 88 applies a downward force to a pull rod 89 which is in turn connected to the cutter arm 62 to bias it in an anti-clockwise direction as viewed in FIG. 5 to maintain the linkage loaded against the action of the cam 54. The spring 88 functions to return the cutter arm to the illustrated position after a cutting operation but a positive mechanical drive is provided by the cam 54 to supply the shearing force necessary for the cutter operation.

Figure 6:
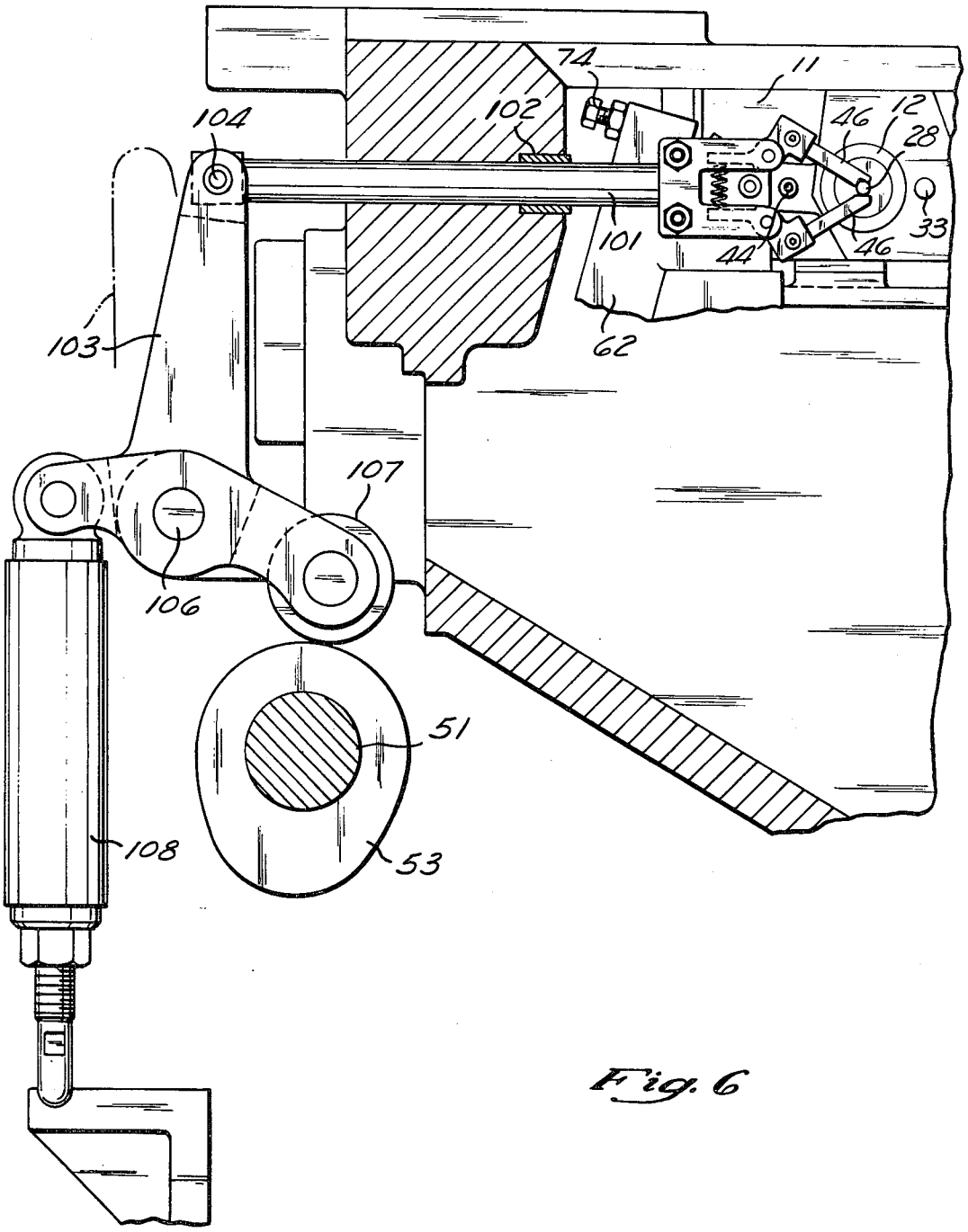
FIG. 6 is a cross section taken generally on along 6—6 of FIG. 2 illustrating the structure and drive for the transfer.

The transfer mechanism is best illustrated in FIG. 6. This mechanism includes a transfer arm 101 slidably mounted bearing 102 and connected to a rocker arm 103 by a pivot pin 104. The rocker arm 103 is pivotably supported on a pivot pin 106 on the machine frame and is provided with a cam follower 107 which engages the cam 53 on the shaft 51. A spring assembly 108 is also connected to the rocker arm to bias the arm in a clockwise direction as illustrated in FIG. 6. In this instance the spring force is utilized to move the transfer forward to the die position illustrated in FIG. 6 and the cam 53 operates to move the transfer back positively to the position in which it receives a blank from the cutter.

Mounted on the forward end of the transfer arm 101 are the transfer fingers 46 which are spring biased toward the gripping position.

The transfer is timed with the operation of the machine so that it moves back to position the fingers 46 for gripping a blank carried by the cutter when the cutter is in position in alignment with the transfer pin 44. While the transfer and cutter remain in such positions the transfer pin 44 operates to push the blank out of the cutter so that the blank is supported only by the transfer fingers 46 for subsequent movement during the next extension of the transfer to position the blank between the two dies 12 and 23 as illustrated in FIG. 2. After the blank is gripped by the two dies as discussed above the transfer is withdrawn so that the fingers are clear of the dies prior to the working operation.

Figure 8:
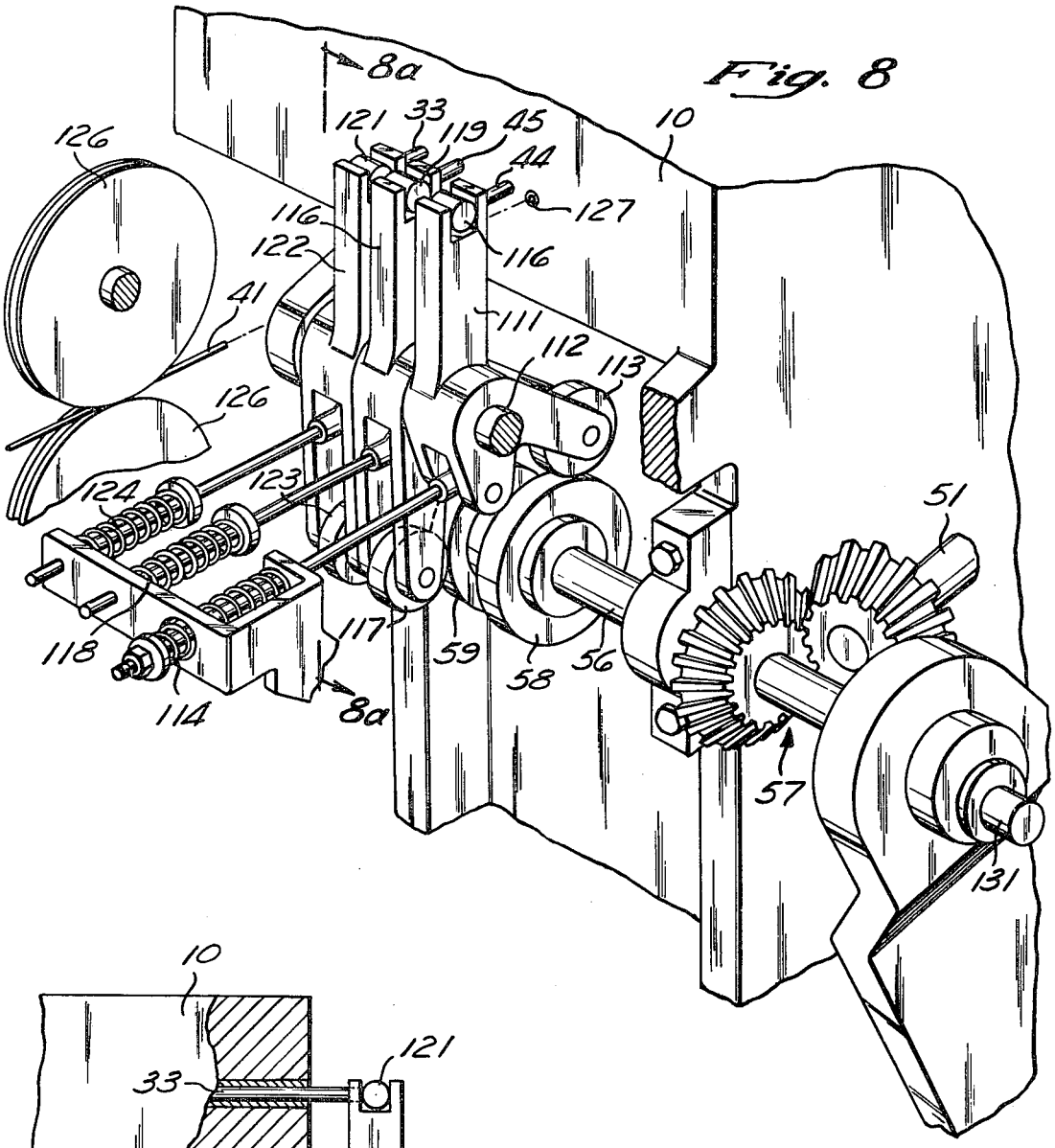
FIG. 8 is a fragmentary prospective view illustrating the wire feed and the cam system for operating the movable die pusher and the two ejectors.
Figure 8A:
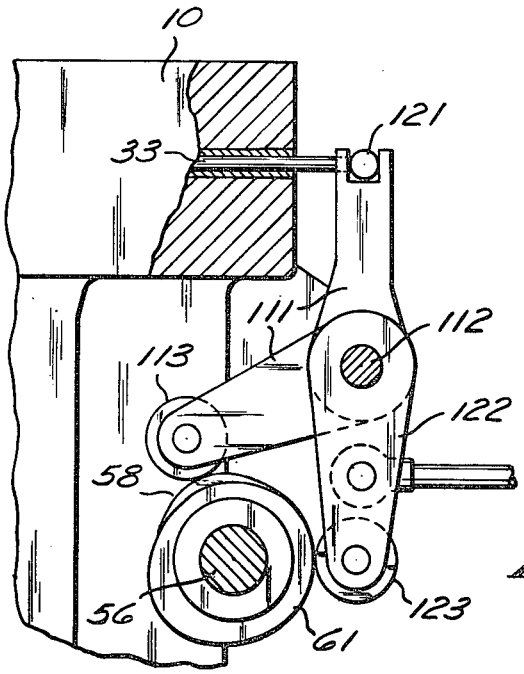
FIG. 8*a* is a fragmentary side elevation taken generally along 8*a*—8*a* of FIG. 8.

Referring to FIG. 8 and **8*a* the transfer pin 44 is operated by a rocker arm 111 journaled on a support shaft 112. A follower 113 on the arm 111 engages the cam 58 causing oscillating rotation of the rocker arm 111 in response to the rotation of the cam 58. A tension spring assembly 114 is connected to the rocker arm to bias the arm 111 in a clockwise direction as illustrated in FIG. 8 and maintains the roller 113 in engagement with the associated cam 58. The upper end of the arm 111 provides a yoke which encloses a cylindrical connector 116 threaded onto the rearward end of the pin 44. Consequently when the cam 58 allows the spring to rotate the arm 111 in a clockwise direction the pin 44 is moved forward by the spring and operates to push a blank from the cutter so that it is supported by the transfer fingers as discussed above. Preferably the pin 44 is threaded into the connector 116** so that the position of the pin can be easily adjusted.

Substantially similar structures are provided for controlling the operation of the die pusher 33 and ejector pin 45. The ejector pin 45 is connected to the upper end of a rocker arm 116 which is also pivoted on the shaft 112 and is provided with a cam follower 117. In this instance, however, the rocker arm 116 is arranged so that it is positively driven clockwise as the ejector pin 45 ejects ball from die and is spring returned. Consequently a compression spring assembly 118 is connected to bias the rocker arm 116 in an anti-clockwise direction to maintain contact between the roller 117 and its associated cam 59. Here again the upper end of the rocker arm 116 is provided with a yoke to receive a cylindrical drive connector 119 connected to the rearward end of the pin 45.

The pusher 33 is provided with a drive connector 121 connecting the pusher to the upper end of a rocker arm 122 which is also pivoted on the shaft 112. Here again a follower 123 is mounted on the rocker arm 122 for engagement with its associate cam 61 illustrated in FIG. **8*a*. A compression spring assembly 124 biases the rocker arm 122 in an anti-clockwise direction as viewed in FIG. 8 so the pusher 33 like the ejector pin 45** is positively driven in the forward direction and is retracted by its associated spring assembly.

Figure 9:
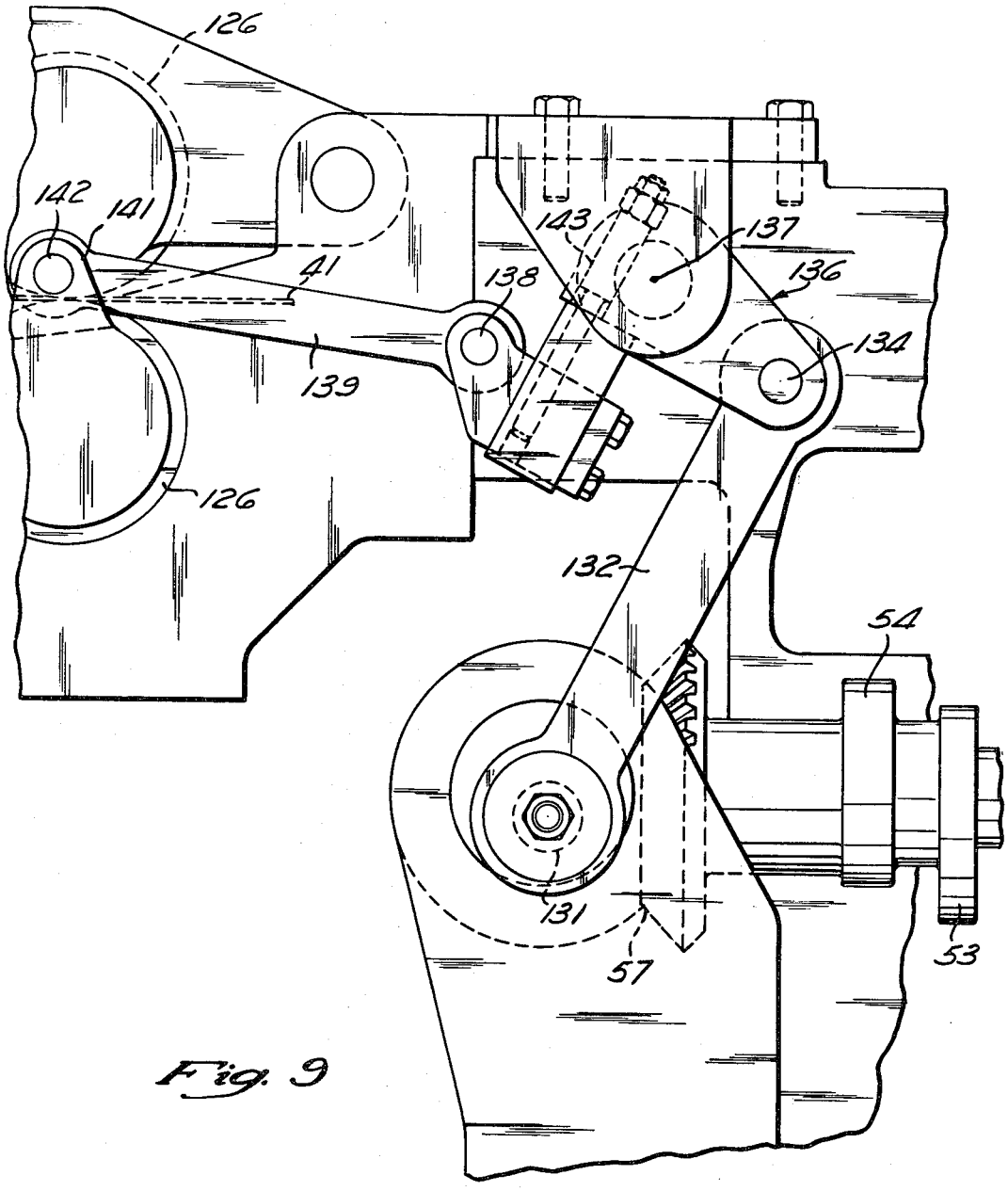
FIG. 9 is a fragmentary side elevation of the mechanism for driving the stock feed rolls; and, FIG. 10 is a timing diagram of the machine illustrating the relationships of the timing of the various operations.

A pair of feed rolls 126 engage the wire stock 41 and operate to feed the stock forwardly into the machine through the stock opening 127 in response to a drive system best illustrated in FIG. 9. This mechanism includes an eccentric crank 131 provided on the end of the shaft 56 which drives a drive link 132. The drive link 132 is connected to a rocker arm assembly 136 at pin 134. Such assembly is pivoted on the machine frame at 137 and is oscillated back and forth around its pivot.

Link 139 is connected to the input arm 141 of the feed rolls by pivot 142 and to rocker arm assembly 136 at pin 138. When the rocker arm assembly 136 is rotated in an anticlockwise direction as viewed in FIG. 9, the feed rolls are driven in the direction causing the wire stock to be fed into the machine in the usual manner. A one-way clutch and brake mechanism prevents backward feed of the rolls when the rocker arm assembly 136 moves in the clockwise direction during the remaining phase of the cycle.

Preferably the rocker arm assembly 136 is provided with an adjustment system 143 which permits the adjustment of the feed stroke while the machine is operating and a lock system which permits the feed to be disengaged or engaged while the machine is operating.

Referring to FIG. 3 a second ejector 151 is provided to ensure ejection of the finished part from the movable die 23. This ejector is operated by the rearward movement of the movable die 23 which causes the rearward end of the ejector pin 151 to engage a stationary stop 152. With this structure it is not necessary to provide separate power drive for the ejector 151 and it operates in response to the movement of the movable die. Springs (not illustrated) extend between each die 12 and 23 and the associated guides 153 to retract the guides and ejector pin 151.

Figure 4:
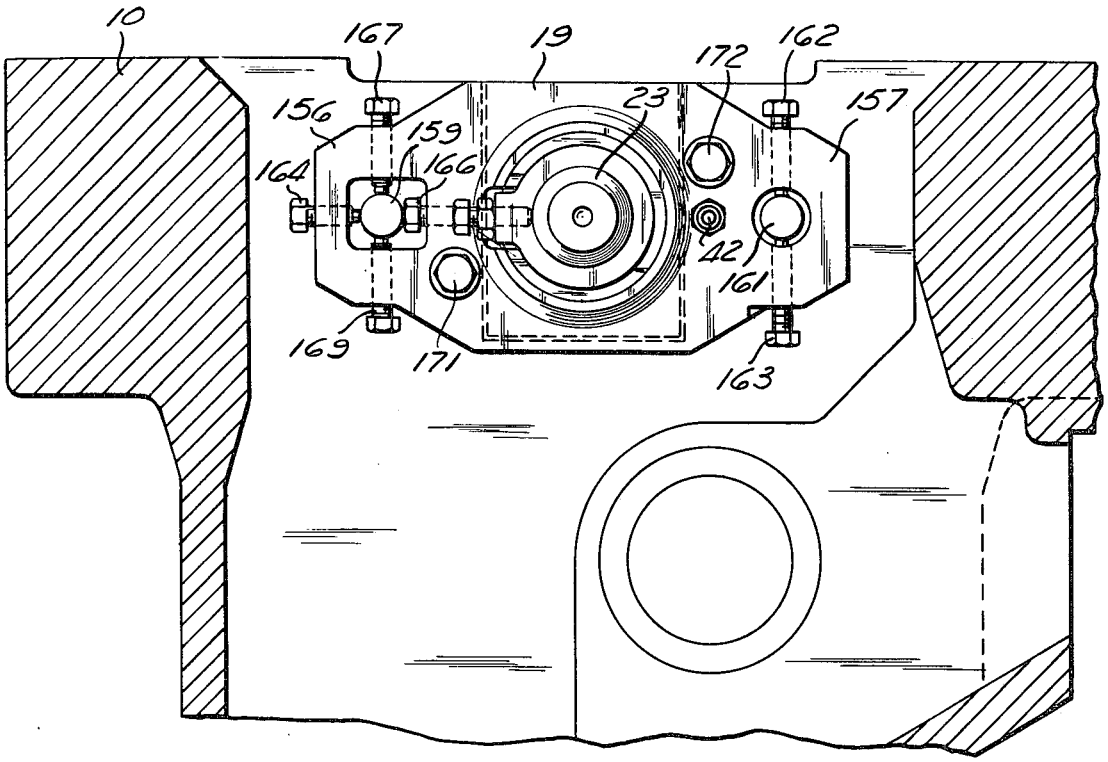
FIG. 4 is a cross section taken generally along the face of the movable die illustrating the structure for positioning such die.

FIGS. 2 and 4 illustrate the structure for adjustably positioning the movable die assembly with respect to the frame. In such structure the die support 19 is provided with lateral extension 156 and 157 which project along the forward surface of frame 10. A pair of pins 159 and 161 project through openings in the extensions 156 and 157 respectively. A pair of opposed screws 162 and 163 extend vertically in the projection 157 and operate to engage opposite sides of the locating pin 161. By adjusting the two screws 162 and 163 the right side of the die holder 19 (as viewed in FIG. 4) can be adjusted up and down and locked in any desired adjusted position.

Located in the extension 156 is an adjusting mechanism including a first pair of screws 164 and 166 which engage laterally opposite sides of the pin 159 and provides for lateral adjustment and positioning of the die holder 19. Vertical adjustment of the left side of the die holder as viewed in FIG. 4 is provided by a pair of screws 167 and 169. The two screws 167 and 169 are adjusted to adjust to the vertical position of the left side of the die holder 19 and for locking the left side in its adjusted position. With this simple structure the position of the tool holder and in turn the movable die can be accurately adjusted within the machine. After adjustment lock bolts 171 and 172 are tightened to maintain the die in its locked position.

Figure 10:
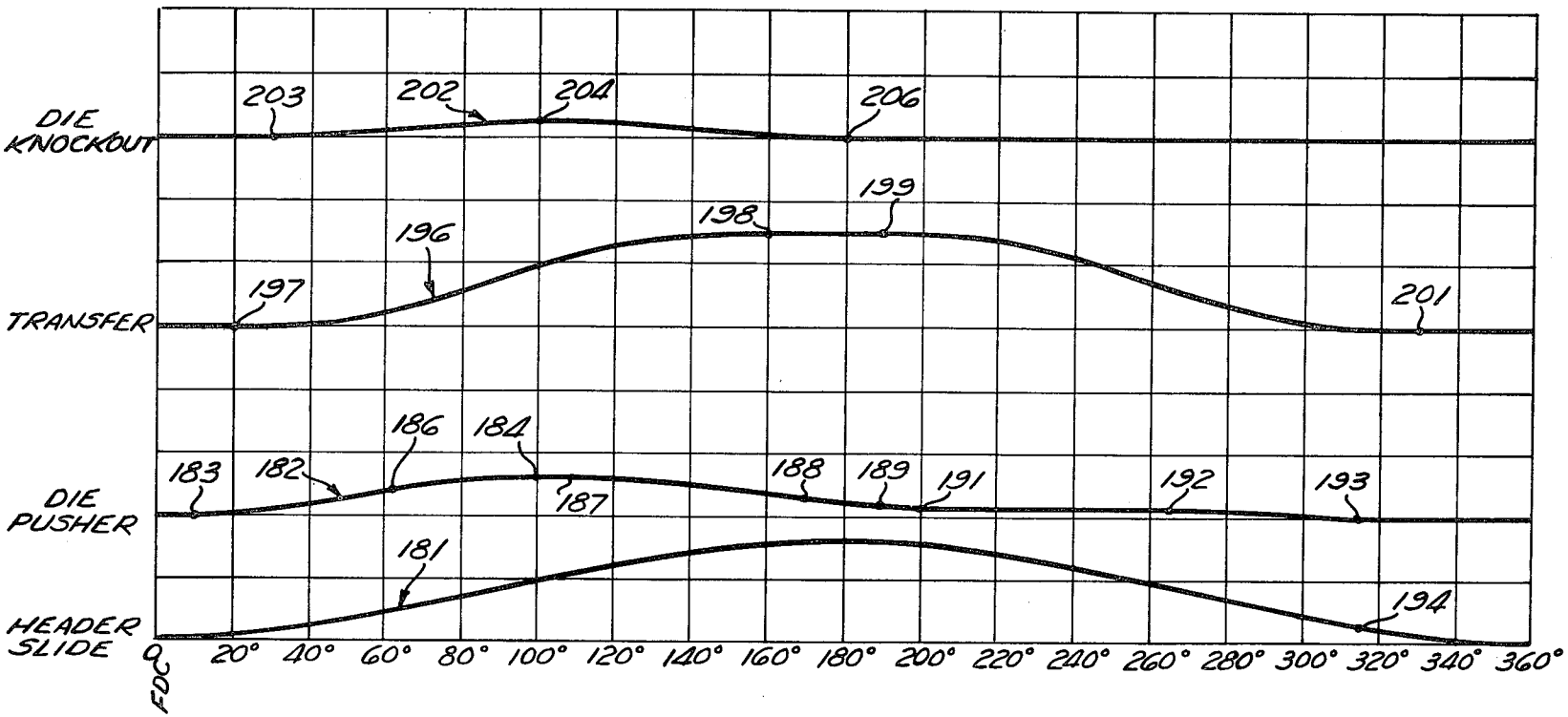

The preferred timing of the machine is best illustrated in FIG. 10 which is a timing diagram for the machine. In this diagram the crankshaft rotation is indicated in the horizontal direction and the movement of the various components or sub-assemblies of the machine are indicated in the vertical direction. In this diagram the actual displacements are not necessarily illustrated to scale.

The lower curve 181 is the curve of the header slide stroke and is substantially harmonic movement through a full cycle in 360° of crankshaft rotation. The crankshaft rotation is illustrated in the horizontal direction starting at the forward dead center position at 0° of crankshaft rotation and is in the back dead center position at 180° of crankshaft rotation.

The movement of the movable die holder 21 is represented by curve 182. The movable die commences to move back from its forward position after about 10° of crankshaft rotation as illustrated at 183 and reaches its fully retracted position at 184 after about 100° of rotation of the crankshaft. The various elements are proportioned so that the movable die knockout 151 engages the fixed stop 152 and commences ejection from the movable die at about 62° at the point 186 along the curve 182. At about 110° of crankshaft rotation at the point 187 the movable die holder 21 commences to move back toward the stationary die 12 and reaches the blank gripping position of FIG. 2 at a location between 170° and 190° in the zone between 188 and 189. The exact location of the gripping within the cycle depends upon the size of the ball and in turn the size of the blank being manufactured in the machine. However, since the gripping of the blank occurs early in the cycle while the header slide is substantially at its back dead center position, it is not necessary to modify the cam when the machine is used to manufacture different sized balls. It should be noted, however, that the cam is causing the die to slow down prior to and within the gripping zone.

The cam 61 which controls the operation of the die pusher 33 is preferably shaped to cause the movable die to dwell at the 200° position illustrated 191 in the event that a blank is not properly positioned for gripping between the dies. If such dwell were not provided and if a blank were not gripped between the dies to prevent continued forward movement of the movable die the die could engage the transfer fingers before they were retracted. However, the provision of the dwell at 191 prevents the movable die from engaging the transfer fingers even when a blank is not position between the dies to prevent such engagement. The movable die dwell ends at about 265° at 192 so the die pusher 33 moves clear of the die to allow the forming operation to occur when the slide engages the movable die. The header slide engages the movable die at about the 315° location illustrated at 193 on the curve 182 and at 194 on the header slide curve 181. The working of the blank occurs between this point and the forward dead center position at 360° which is only about 45° of the crankshaft rotation.

The transfer movement is illustrated by the curve 196. The transfer commences to move toward the die from the position in which it receives the blank from the cutter at about the 20° location at 197. The transfer reaches the center line of the die at the 160° position at 198. Therefore about 140° of crankshaft rotation is allowed for the extension of the transfer.

It should be noted that the dies commence to close at the 110° position before the transfer reaches the center line. However, sufficient clearance is provided to allow the completion of the transfer operation before the die is closed sufficiently to interfere with the transfer operation.

The transfer dwells at the center line of the dies to the 190° position by which time the blank is gripped between the dies to allow the retraction of the transfer without losing control of the blank. The retraction of the transfer continues from the point 199 at about the 190° position to the 330° position at 201. Here, again, a substantial period of time is available for retraction of the transfer period. In the illustrated embodiment such retraction occurs through 140° of crankshaft rotation. The transfer then dwells while the blank is pushed out of the cutter at the blank receiving position.

The operation of the ejector or kick-out 45 is illustrated by the curve 202. The kick-out is commenced at 30° at 203 and continues to the 100° position at 204. Consequently the ball is ejected before the subsequent blank is carried by the transfer into the working position. Preferably a jet of compressed air is directed against the ball to facilitate its movement from the die area. The kick-out returns to its retracted position by the 180° position at 206, so it does not interfere with the gripping of the blank or the subsequent working thereof.

With the preferred embodiment of this invention 140° of crankshaft rotation is available for the extension of the transfer and again for the retraction of the transfer. Consequently, the portion of the cycle available for transfer operation is increased and higher machine speeds can be achieved. This increased period of the cycle available for transfer operation results from the fact that the gripping of the blank and the commencement of transfer retraction occurs while the header slide is substantially spaced from its forward dead center position. As mentioned above the gripping of the blank occurs in the illustrated machine while the header slide is substantially at its rearward dead center position.

It has been determined during testing of the machine described herein that very substantial improvements of tooling life are obtained when compared to the prior art types of machines mentioned above. This improved tooling life has been achieved in spite of the fact that the present machine has been operated at substantially increased speeds.

In prior art machines of the type described in the introduction of the specification it is understood that experience has established that new carbide tools are capable of producing on the order of 500,000 balls before sufficient die errosion occurs to require tool refinishing or replacement. Such tool life experience has been encountered when such machines are operating at speeds of no greater than about 600 cycles per minute.

On the other hand with the machine in accordance with this invention when operating at 720 cycles per minute carbide tooling has successfully produced about 1,250,000 balls without requiring tool replacement or tool refinishing. In fact such tooling appears capable of producing even greater numbers of satisfactory balls.

It is believed that this improved die life even at substantially greater operating speeds occurs principally because the impact velocity of the tooling at the instant the blank is engaged is substantially less than the corresponding impact velocity of such prior art machines even though the machine is operating at substantially higher speeds. To a lesser extent it may also be that the closed ring cutter which forms squarer ends than open cutters may also contribute to improved die life.

In accordance with the present invention the velocity of the die 23 at the instant it grips the blank 28 is determined solely by the shape of the cam which controls the movement of the die pusher 33. The velocity is completely independent of the velocity of the slide 16. The cam 61, as discussed above, allows the die 23 to move forward under the influence of the air pressure and the velocity of the die 23 is substantially lower than the velocity which would occur if the die 23 were carried by the slide and moving at slide velocity at the instant the blank is gripped.

It is believed that the rate of tooling wear is a function of the velocity of the die 23 at the instant the blank 28 is first gripped since such velocity determines to a great extent the localized pressure developed between the points of engagement between the rough ends of the blank and the die surface. It should be understood that even though the blanks illustrated in the drawings are represented as providing smooth ends there are surface irregularities produced during the shearing operation even with a closed ring shear and such irregularities can and do produce points or locations of high pressure on the surface of the die at the instant the blank is engaged. Such localized high pressure is believed to be the principal cause for the errosion or wear which occurs in the surface of the die as the machine is operated to produce workpieces.

Because the engagement between the ends of the blank 28 and the dies 12 and 23 occurs while the die 23 is moving at a relatively low velocity the instantaneous localized pressures are much lower than would be present with high impact velocities. However, the velocity of the die 23 is sufficiently high to perform sufficient deformation of the blank to deform such points and establish an area of smooth mating engagement between the ends of the blank 28 and the dies 12 and 23 to distribute the subsequent working force which is applied during the second phase when the die 23 is moved by the slide 16 to perform the principal forming of the blank.

In other words the forming of the blank occurs in two phases. The first phase involves a small amount of deformation of the blank, which occurs when the blank is first gripped between the dies 12 and 23, and while the die 23 is moving at a low velocity determined by the shape of the cam 61. During the second phase of working the die 23 is moved by the slide 16 at a velocity determined by the crank and pitman connection and the speed of the shaft 13.

Since the point or line contact between the blank and the dies which occurs when the blank is initially gripped has been eliminated and changed to mating area contact during the first phase, the destructive or wear producing pressures do not occur during the second phase of the forming operation even though the velocity is greater, in a machine according to the present invention, because the machine operates at higher speeds.

For example, in the prior art machine discussed, when the machine was operating at 600 rpm the velocity of the die at the instant the blank is first gripped when manufacturing five-sixteenths inch balls is about 50.5 inches per second. When such machines are used to manufacture one-quarter inch balls the die velocity is about 50 inches per second.

With the machine disclosed and claimed herein operating at a substantially higher speed of 720 cycles per minute the velocity of the die 23 at the moment the blank 28 is initially gripped is about 25.5 inches per second when manufacturing five-sixteenths inch balls, and about 18 inches per second when manufacturing one-quarter inch balls. This reduction in gripping velocity, when manufacturing smaller balls, results from the fact that the cam 61 is shaped to stop the die and maintain it stationary between the points 191 and 192 as illustrated in FIG. 10 to prevent damage to the machine in the event that a blank is not located between the dies and because the point of initial gripping of a smaller blank required for smaller balls occurs along the curve closer to the point 191 after the die 23 is further slowed in its movement by the cam 61.

In accordance with the present invention even slower velocities can be obtained at the instant the blank is first gripped by appropriately shaping the cam 61 to produce such slower velocities.

It is pointed out that the slide velocity and in turn the velocity of the movable die at the commencement of the second phase, during which the principal working of the blank occurs, is about 39 inches per second in the prior art machine when operating at 600 cycles per second, and is proportionately higher at the commencement of the second phase of working in the present machine because the present machine was operating at substantially higher speeds. With the present machine operating at 720 cycles per second the velocity of the slide and in turn the velocity of the die 23 is about 46.5 inches per second at the commencement of the second phase of the forming operation.

As mentioned above, it is believed that the improved squareness obtained with the closed ring cutter may also contribute to some extent to the improved die life since it tends to distribute the load on the surface in an improved manner. However, surface irregularities do occur at the end of blanks even when cut with a closed ring cutter which produce points of localized high pressure and the very substantial improved die life realized with the present invention is believed to result primarily from the reduced velocity of the die 23 at the instant the blank is first engaged during the first phase of the operation thereon. In fact, the weight of the tool assembly which includes the die 23 in the present machine is substantially higher than the corresponding weight of the tool assembly in such prior art machines. Further, the force on the tool is higher on the present machine. Consequently, the velocity appears to be the principal contributor to the improved die life.

It should be understood that although this invention is disclosed in connection with the manufacture of balls the invention is not limited to the manufacture of such parts and is applicable to the forming of other parts, such as but not limited to, tapered roller bearings, barrel rollers and phillips head screws or the like.

Although a preferred embodiment of this invention is illustrated, it is to be understood that various modifications and rearrangements may be resorted to without departing from the scope of the invention disclosed and claimed.

I claim:

1. A cold former comprising a frame, a pair of dies mounted on said frame for relative movement between a retracted position spaced from each other to allow positioning of a workpiece between said dies and a closed forward position to deform such workpiece to a required shape; power means operable to move said dies from said retracted position to an intermediate gripping position so that such workpiece is initially gripped while said dies are moving relative to each other with a first relative velocity and to thereafter move said dies from said gripping position to said closed position with an initial second relative velocity which is substantially greater than said first relative velocity, said first relative velocity being sufficiently lower than said second velocity to substantially reduce the rate of errosion of said dies below the rate which would occur if said workpiece were initially gripped by said dies moving at said second velocity.

2. A former comprising a frame, the stationary die on said frame, a movable die on said frame movable between a retracted position spaced from said stationary die to allow positioning of a workpiece between said dies and a forward position to deform such workpiece to a required shape; power means operable to move said movable die from said retracted position to an intermediate gripping position so that such workpiece is initially gripped while said movable die is moving with a first velocity, and to thereafter move said movable die from said gripping position to said forward position with an initial second velocity which is substantially greater than said first velocity, said first velocity being sufficiently low to prevent excessive errosion of said dies when said workpiece is initially gripped.

3. A former as set forth in claim 2 wherein said power means includes a cam operating to control the movement of said movable die during said first phase, and a crank and pitman operating to control the movement of said movable die during said second phase.

4. A former as set forth in claim 2 wherein said power means includes a first power drive operated to control the movement of said movable die during said first phase, and a separate power drive operating to control the movement of said movable die during said second phase.

5. A former as set forth in claim 2 wherein said first velocity is sufficiently great to deform said workpiece an amount necessary to create an area of mating engagement between said workpiece and said dies and to substantially reduce the existence of sharp protrusions on the workpiece engaging the surface of said dies.

6. A former as set forth in claim 2 wherein said first velocity is no greater than about 50 percent of said second velocity.

7. A cold former for balls, tapered rollers, barrel rollers, phillips head screws, or the like comprising a frame, a stationary die on said frame, a movable die on said frame movable between a retracted position spaced from said stationary die to allow positioning of a workpiece between said dies and a forward position to deform such workpiece to a required shape, first means causing movement of said movable die from said retracted position to a gripping position in which a workpiece is initially gripped between said dies, second means causing said movable die to move from said gripping position to said forward position for deforming said workpiece, said first means producing a first velocity of movement of said movable die when said dies first grip said workpiece which is sufficiently slow to prevent excessive die errosion and sufficiently great to deform said workpiece an amount necessary to create an area of mating engagement between said workpiece and said dies, said area of mating engagement being sufficiently great to substantially eliminate die errosion during said second phase.

8. A cold former as set forth in claim 7 wherein a closed cutter operates to cut said workpieces from elongated stock for deformation between said dies and produces workpieces which are generally cylindrical having substantially square but rough ends.

* * * * *